US010286715B2

(12) United States Patent
Aniban, Jr.

(10) Patent No.: US 10,286,715 B2
(45) Date of Patent: May 14, 2019

(54) METHOD AND APPARATUS FOR COMBINING, STORING AND RETAILING MULTIPLE STORAGE DEVICES OR RECORDING MEDIUMS CONCEALED WITHIN A GREETING CARD AND ALIKE TO CREATE A TRADITIONAL GREETING CARD WITH LITERATURE AND ART WITH MODERN STORAGE DEVICES OR RECORDING MEDIUMS SUCH AS BUT NOT LIMITED TO COMPACT DISC, USB DRIVE'S, MONETARY DEVICES TO FURNISH A WAY TO SEND BUT NOT LIMITED TO AUDIO, VIDEO'S, PHOTO'S, LITERATURE AND INFORMATION ETC'S WITH A GREETING CARD

(71) Applicant: Raymond Aniban, Jr., Ewa Beach, HI (US)

(72) Inventor: Raymond Aniban, Jr., Ewa Beach, HI (US)

( * ) Notice: Subject to any disclaimer, the term of this patent is extended or adjusted under 35 U.S.C. 154(b) by 0 days.

(21) Appl. No.: 14/545,225

(22) Filed: Apr. 8, 2015

(65) Prior Publication Data

US 2016/0297230 A1 Oct. 13, 2016

(51) Int. Cl.

| | |
|---|---|
| ***G09F 1/00*** | (2006.01) |
| ***B42D 15/04*** | (2006.01) |
| ***B42D 15/02*** | (2006.01) |

(52) U.S. Cl.

CPC ..... *B42D 15/045* (2013.01); *B42D 15/022* (2013.01)

(58) Field of Classification Search

USPC ..... 40/124.06, 124.13

See application file for complete search history.

(56) References Cited

U.S. PATENT DOCUMENTS

| | | | | |
|---|---|---|---|---|
| 3,405,467 | A * | 10/1968 | Preston | B42D 15/08 40/124.06 |
| 6,328,160 | B1 * | 12/2001 | Cooksey | B65D 5/0005 206/224 |
| 6,666,378 | B2 * | 12/2003 | Davila | B42D 15/042 235/380 |
| 2004/0020085 | A1 * | 2/2004 | Ferguson | B42D 15/045 40/124.06 |

(Continued)

*Primary Examiner* — Joanne Silbermann

(74) *Attorney, Agent, or Firm* — Russ Weinzimmer & Associates, P.C.

(57) ABSTRACT

A greeting card, and envelope designed and or formatted to reconfigure to accept and conceal a receptacle by dimension, which stores at least one recording or recorded storage device, medium. or media such as but not limited to DVD's, CD's, Compact disc, USB drive's, gift card's, paper currency, etc. The storage devices or mediums allows the giver to download, record, combine and store image's graphic, photo's video's, music, art poetry, literature, records, etc., from an authorized website's and can be combined with personal all reserves in a greeting card and create a personal customized album. The images, audio and information can be downloaded on the receiver's PC and selected images, audio and the information can be duplicated and printed such as photos can be framed, used as wallpaper etc., and the original storage devices or medium can be stored with the greeting card and receptacle can be stored as albums.

6 Claims, 7 Drawing Sheets

(56) References Cited

U.S. PATENT DOCUMENTS

| | | | | |
|---|---|---|---|---|
| 2006/0032764 | A1* | 2/2006 | Swenson | B42D 15/045 206/232 |
| 2008/0047173 | A1* | 2/2008 | Wilen | B42D 15/02 40/124.06 |
| 2010/0126890 | A1* | 5/2010 | Libohova | G11B 33/045 206/307 |
| 2010/0326852 | A1* | 12/2010 | Fournillier | G11B 33/04 206/308.1 |
| 2013/0036635 | A1* | 2/2013 | Mayer | G09F 9/30 40/124.06 |

* cited by examiner

METHOD AND APPARATUS FOR COMBINING, STORING AND RETAILING MULTIPLE STORAGE DEVICES OR RECORDING MEDIUMS CONCEALED WITHIN A GREETING CARD AND ALIKE TO CREATE A TRADITIONAL GREETING CARD WITH LITERATURE AND ART WITH MODERN STORAGE DEVICES OR RECORDING MEDIUMS SUCH AS BUT NOT LIMITED TO COMPACT DISC, USB DRIVE'S, MONETARY DEVICES TO FURNISH A WAY TO SEND BUT NOT LIMITED TO AUDIO, VIDEO'S, PHOTO'S, LITERATURE AND INFORMATION ETC'S WITH A GREETING CARD

CROSS-REFERENCE TO RELATED APPLICATIONS

This application claims priority from U.S. Provisional Application Ser. No. 61/995,493 filed Apr. 10, 2014.

FIELD OF THE INVENTION

This invention relates to both greeting cards and data storage and/or recording media.

BACKGROUND OF THE INVENTION

Sending photos, videos, text, poetry, art, literature, and similar media electronically as part of an electronic communication such as a text or an email to commemorate a special occasion has its drawbacks. First, it lacks the traditional feel of a physical greeting card. Relationships are important, and commemorating occasions such as Mother's Day, Father's Day, an Anniversary, a Birthday, or just to tell a loved one that they are special can be enhanced with a more personal and traditional touch. Secondly, the amount of media data that can be attached to such an electronic communication can be limited. If it's true that a picture's worth a thousand words, then sending a greeting card along with an abundance of media such as photos, videos, poetry, etc. with a traditional touch can be worth much more.

Traditional greeting cards are, however, limited to what the envelope accompanying the card can contain. Thus, attempts to include media with a traditional greeting card will likely require a larger mailing package, and even that can be content limiting and can require additional postage fees based on the increased size. Also, by deviating from the original envelope of the greeting card can also detract from the traditional greeting card style and attraction.

In the past, when sending media such as photos with a greeting card for a special occasion, a developed photo was sent with the greeting card. Today, media such as photos are often sent electronically as attachments to emails and texts and at different times. Compact disc storage cases are limited to one type of media storage device and aren't typical of packaging sent with a greeting card, gift card, photos etc.

SUMMARY OF THE INVENTION

An embodiment of the invention allows a sender to safely and privately send photos, videos, music, literature, monetary gift cards and similar media stored on various types of storage devices along with a traditional greeting card that unlike an electronic message, does not leave such personal media vulnerable to hackers.

The sender selects a desired greeting card. If the sender desires to send photos, videos, literature and similar media, it can be stored on various known types of storage devices. The greeting card and envelope are designed to adapt to a receptacle of the invention. The storage devices are loaded with the desired media content, selective adhesive compartment covers are removed and the media storage devices are then inserted in their respective designated compartments of the receptacle. The receptacle is attached to the greeting card inserted into the designed envelope and mailed. Everything is sent and received in a single communication that maintains a more traditional and personal way of sending photo's, video's literature, and similar media on a special occasion.

An embodiment of the invention provides a sender a greeting card adapted to include a quality and quantity of photo's, video's, audio, literature, poetry, and other similar media within a greeting card and a stylish mailing package format, rather than being sent electronically with minimal privacy, security, and limitations on the amount of data that can be sent at one time.

A sender can design his own CD, DVD, poetry, graphic's, photo albums, etc. from an authorized website. This allows the receiver to view the visual content, listen to audio content and print the desired content. The recipient can receive access to an abundance of recorded content stored within the data storage devices, while being received in a package as small as a greeting card. The greeting card content can then be stored in the form of photo albums and labeled with a date and noting the occasion the card is intended to commemorate. An embodiment of the invention provides a method and apparatus that allows a sender of the greeting card to send an abundance of desired photo's, videos, music, art and literature etc., allowing the receiver to receive these items in a single communication having a traditional touch.

Figure 1:
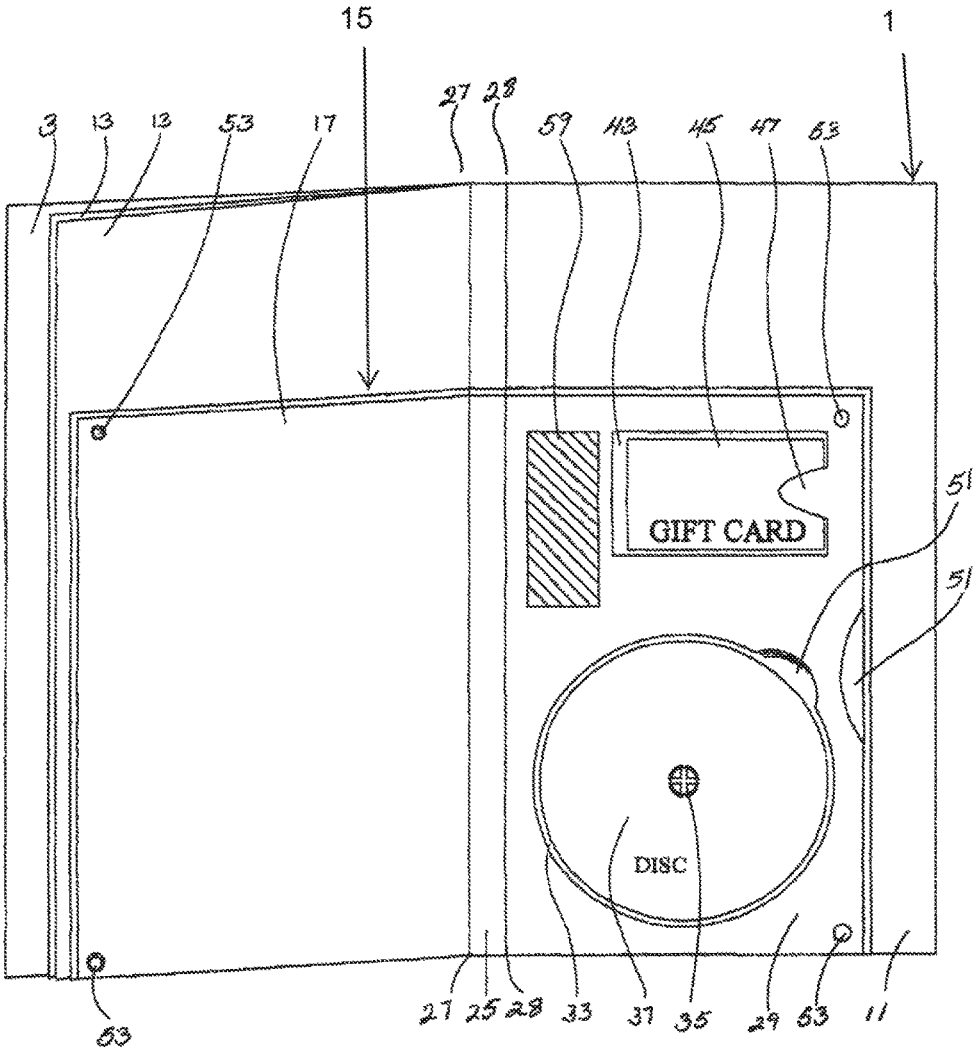
FIG. 1 shows the receptacle fastened within an open greeting card between a literature sheet and a back of the receptacle with an adhesive removable cover covering a medium compartment.

| Reference Numeral in Drawings |
|---|
| 1. greeting card |
| 3. front cover of greeting card |
| 5. living hinge of greeting card |
| 7. spine of greeting card |
| 9. crease on spine of the greeting card |
| 11. back cover of greeting card |
| 13. literature sheet |
| 15. receptacle |
| 17. front cover of receptacle |
| 19. clear lament |
| 21. advertisement |
| 23. insert |
| 25. spinc of reccptade |
| 27. living hinge of receptacle |
| 28. standby hinge |
| 29. back of receptaclc |
| 33. compact disc compartment |
| 35. Disc release button |
| 35. Disc release button |
| 37. compact disc |
| 39. storage device or USB compartment |
| 41. storage device or USB |
| 43. monetary value device compartment |
| 45. monetary value device |
| 47. monetary value device brace |
| 49. storage device supports |
| 51. finger recess |
| 53. tab |
| 57. adhesive |
| 59. adhesive compartment covers |
| 61. accordion design envelope |

DETAILED DESCRIPTION

Figure 4:
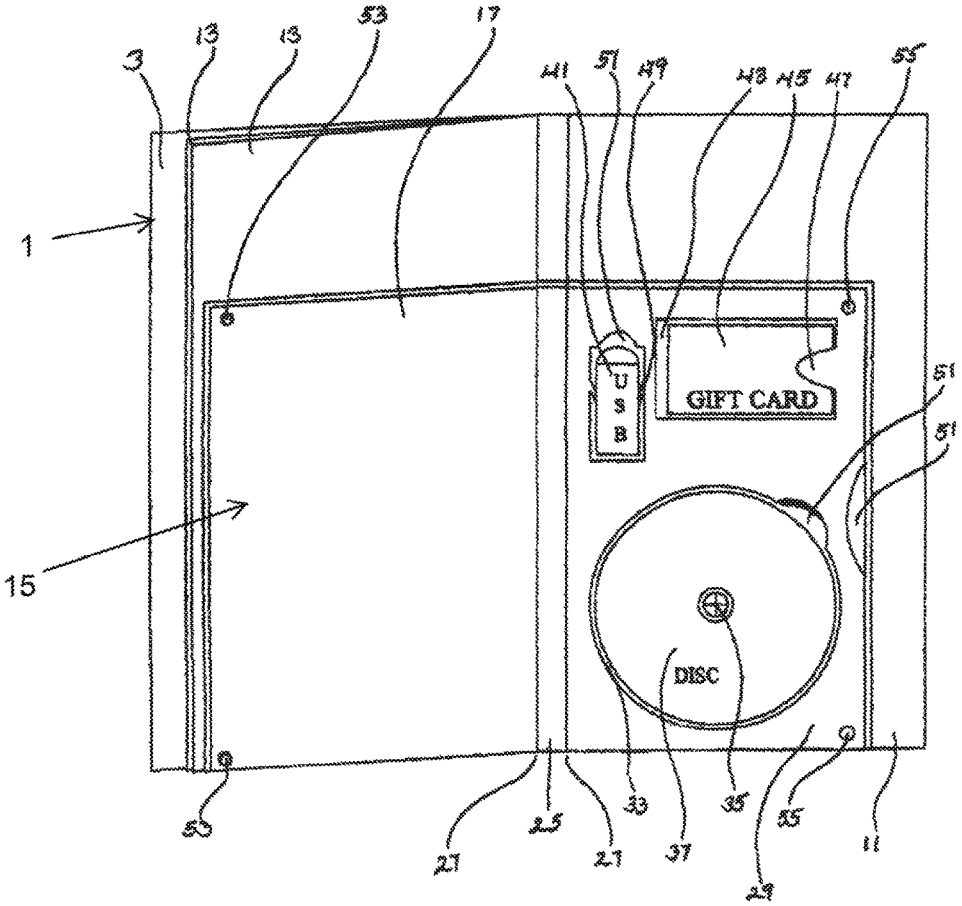
FIG. 4 shows the invention with the receptacle fastened within an open greeting card between the literature sheet and the back of receptacle with an adhesive removable cover removed from a medium compartment.
Figure 6:
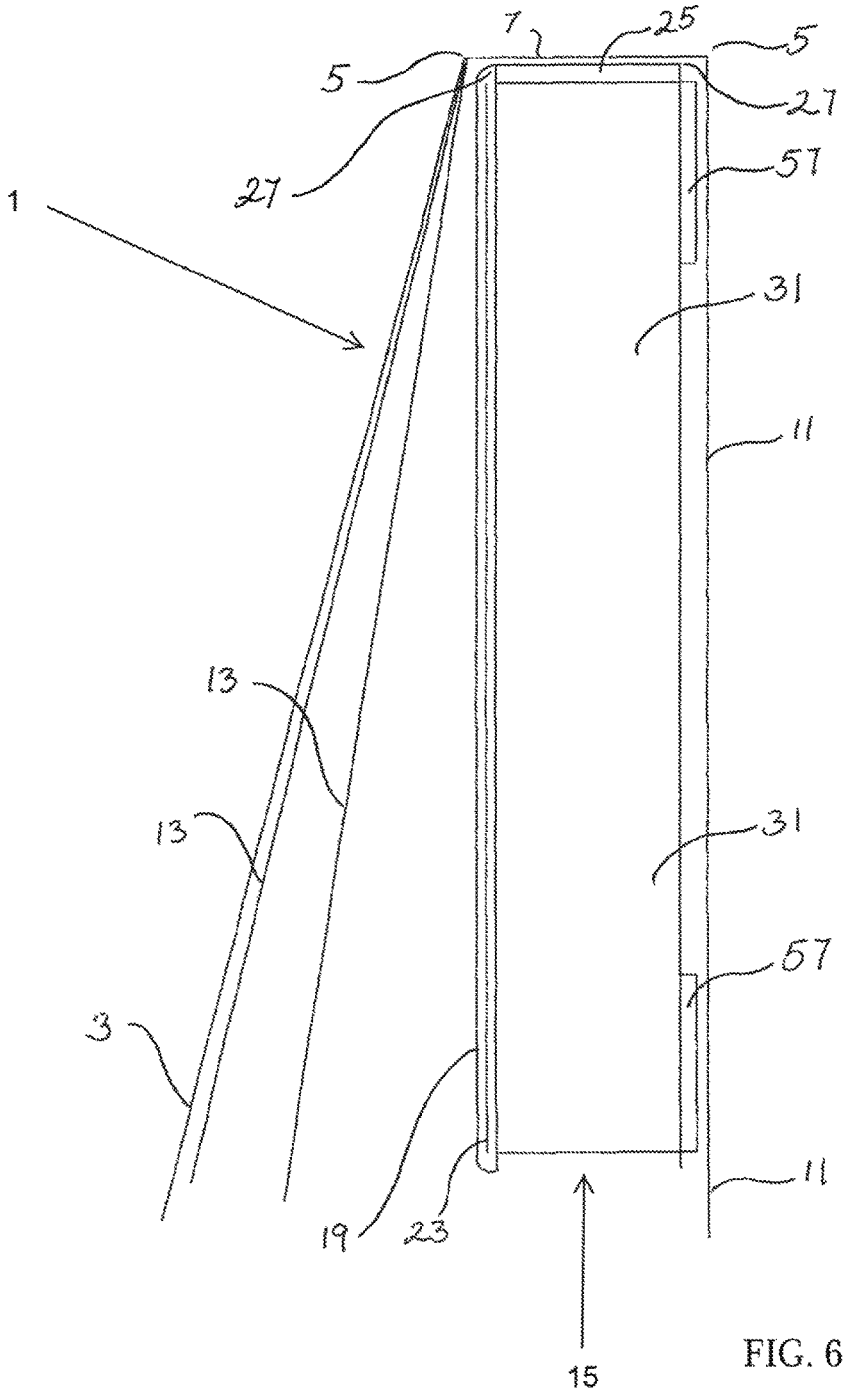
FIG. 6 shows a top view of the receptacle fastened within the greeting card.

FIGS. 1, 4 and 6 illustrate a greeting card 1 having hinges 5, which allows a receptacle 15, to fit within the dimension of the front cover 3, the back cover 11, and the spine 7 of greeting card 1, the receptacle 15 being configured to be attached or adhered to the greeting card 1 as illustrated in FIGS. 1, 4, and 6.

Figure 2:
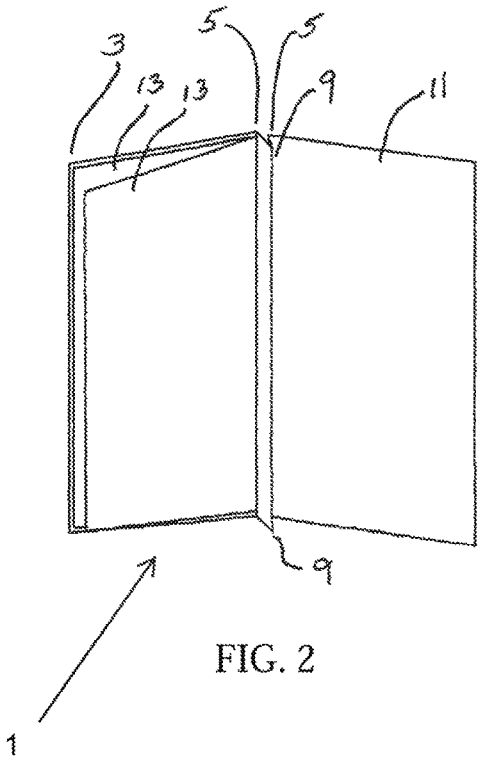
FIG. 2 shows the greeting card with two hinges and a crease therebetween along the length of the spine of the greeting card.
Figure 3:
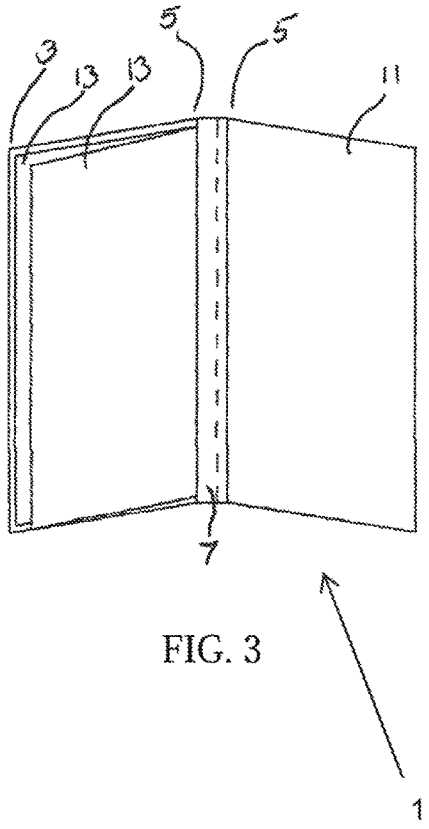
FIG. 3 shows the greeting card adapted for accepting the receptacle.

The greeting card 1 has a crease 9 along the spine 7 between two hinges 5 as shown in FIGS. 2 and 3. This is unlike a traditional greeting card, which usually has only one living hinge. The crease 9 flattens the spine 7 and causes the two living hinges 5 of the greeting card to operate as a single hinge 5 at the front cover 3 of the greeting card 1, in a manner similar to that of a traditional single-hinged greeting card. Flattening the crease 9 re-establishes the spine 7 and enables two hinge operation of the greeting card by expanding the spine 7 of the greeting card 1 to enable it to receive the spine of 25 of the receptacle 15.

The crease 9 along the spine 7 of the greeting card 1 does not necessarily have to be centered evenly between the living hinges 5 of greeting card 1 as is shown in FIGS. 2 and 3. By offsetting the crease 9 along the spine 7 of greeting card 1, just one portion of spine 7 that includes the hinge 5 that is coupled to the front cover 3 of greeting card 1 will be visible when facing the front cover 3 of greeting card 1.

The greeting card 1 may also have multiple literature sheets 13, preferably located between or within the front cover 3 of greeting card 1, and a front cover 17 of the receptacle 15 as is shown in FIGS. 1, 2, 3, 4, and 6.

The receptacle 15 is configured to receive and retain at least one storage device as shown in FIGS. 1 and 4, each of which may have prerecorded or recorded photos, images, literature, videos, music, records, and other media data stored thereon.

The receptacle 15 may be constructed by the same method as known compact disc storage packs, or may be constructed by other methods such as, but not limited to, injection molding. The receptacle can be made in a vast arrange of colors and may be made of recyclable materials.

The receptacle 15 includes a front cover 17, a spine 25, living hinges 27 a back cover 29, storage body 31 formed between the cover 17 and the back cover 29. Receptacle 15 further includes finger recesses 51, male tab 53, female slot 55, compact disc compartment 33, storage device or USB compartment 39, monetary value device compartment 43, clear laminate 19, advertisement 21, fastening means 57, which can be for example, and adhesive strip or two-way tape, as illustrated in FIGS. 1, 4 and 5.

The front cover 17 and the back cover 29 of receptacle 15 are connected to the spine 25 by living hinges 27 of the receptacle 15.

The clear laminate 19 is fastened to the three sections of the receptacle 15, and is preferably fastened to at least the front cover 17. The clear laminate 19, is fastened on three sides leaving at least one side open as shown in FIG. 5. This allows an insert 23, such as but not limited to a title of an occasion, a photo, a poem, etc. to be inserted thru the side of the clear laminate 19, which is preferably not fastened to the front cover 17 of receptacle 15. The clear laminate 19 can also have an advertisement 21 on one side, which allows the company or publisher of the greeting card 1 and receptacle 15 to advertise their product to the sender and receiver, such as through providing a view of the brand name or trademark as shown in FIG. 5.

Figure 5:
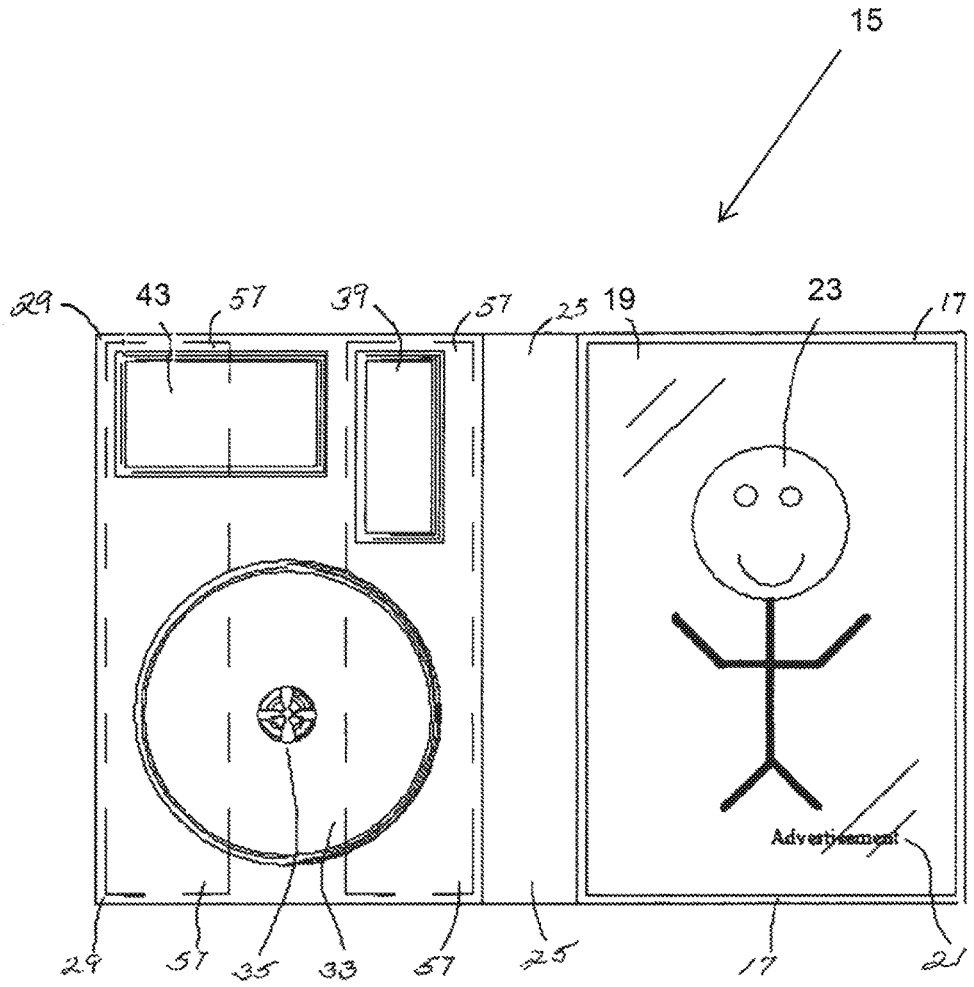
FIG. 5 shows the front cover, spine and back of the receptacle with fastening strips along the back of the receptacle.

The storage body 31 formed between the front and back covers of receptacle 15 may include a compact disc compartment 33, which holds in place at least one compact disc, CD, DVD, etc. as shown in FIGS. 1, 4 and 5. The disc release button 35 has two functions. The disc release button 35 as shown in FIGS. 1, 4 and 5 holds the disc in place, and releases the disc when pressed in a downward direction while using the finger recess 51 to lift the edge of the compact disc 37 in an upward direction. Button 35 may be of many different known designs. Compact disc packs or cases have a variety of known designs for a compact disc release apparatus.

The storage device or USB compartment 39 consists of the storage device supports 49, which secure the storage device or USB drive 41 when the storage device or USB drive 41 is stored in the receptacle 15 as shown in FIG. 4. Finger recess 51 allows the storage device, or USB drive 41 to be removed with a finger.

The monetary value device compartment 43 includes a monetary value device brace 47 as shown in FIGS. 1 and 4. Once the storage devices have been loaded with stored media data, the compartment covers 59 are removed and the media storage devices are inserted into their designated compartments. The compartment covers can be made of an adhesive, strip of material. The receptacle 15 is then closed by pressing male tabs 53 of front cover 17 of receptacle 15 into female slots 55 of the storage body 31. The compartment covers 59 may be left to cover unused compartments when a particular type of storage device for the unused compartment is not used. The compartment covers may cover the compartments at the time of purchase and then removed, or vice versa.

Figure 7:
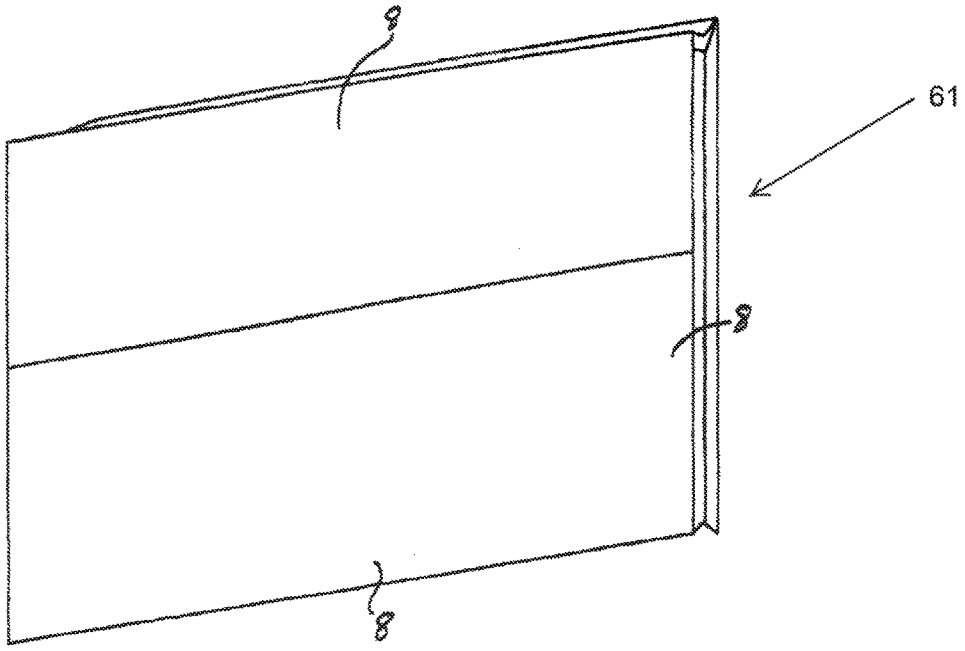
FIG. 7 shows a view of the accordion design envelope partly expanded to accept the greeting card with the receptacle fastened therein.

The accordion design envelope 61, as shown in FIG. 7 can be produced a vast range of colors, and preferably a color that matches the greeting card 1, or that is appropriate for the occasion to which the greeting card is to commemorate (e.g. red for Valentine Day).

Figure 8:
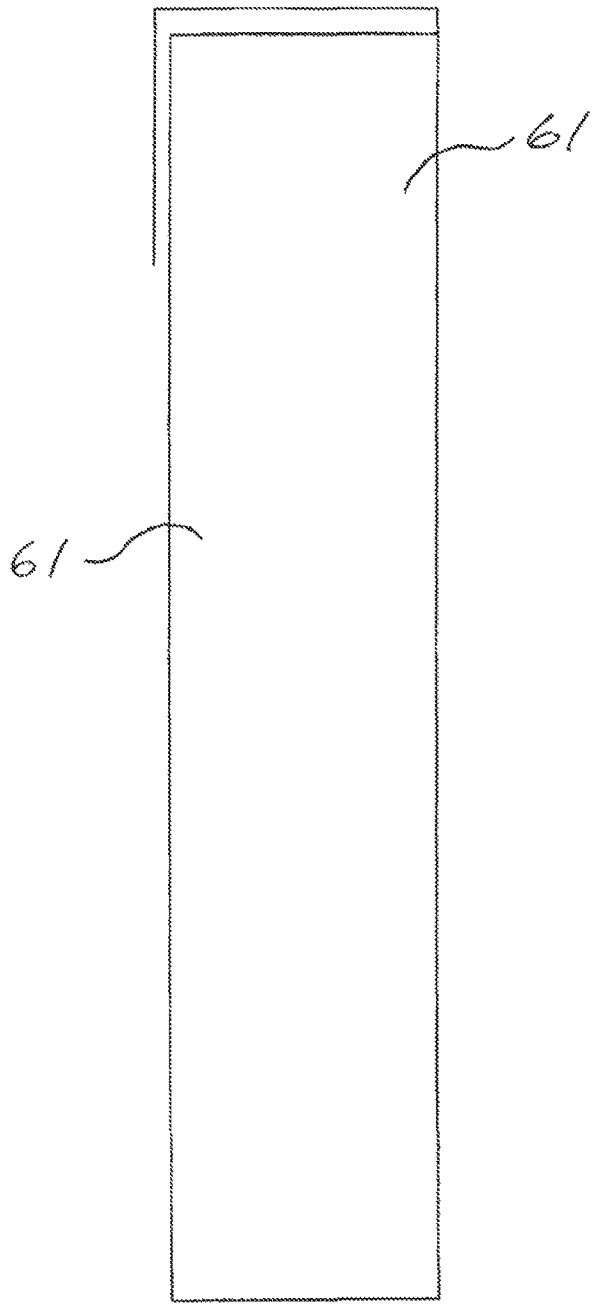
FIG. 8 shows the accordion design envelope with the greeting card and receptacle inserted within the accordion design envelope.

The accordion design of envelope 61 serves multiple purposes, including making it more compact when placed in a flattened state during shipping from a manufacture, thereby saving space, which saves on shipping costs and lessens the chance of damage. The accordion design further permits the envelope to expand to the dimensions of the combination of the greeting card 1 and receptacle 15 to accommodate the combination as shown in FIG. 8.

Thus, a sender or giver can select and purchase the greeting card 1, that is designed, constructed and or formatted as shown in FIGS. 2 and 3. If the sender wishes to also send media such as photos, videos, music, literature, monetary gift cards, and the like, using the receptacle 15, the selected greeting card 1 is then reconfigured with the purchase and attachment to greeting card 1 of a receptacle 15 as shown in FIG. 3. The selected greeting card 1 configured so that it can be sent with or without the receptacle 15 as shown in FIGS. 2 and 3. Thus, a manufacturer of greeting cards can construct a single design for their greeting cards (i.e. greeting card 1) that can be sold as a conventional greeting card, but that can be reconfigured to accommodate the receptacle 15 as shown in FIGS. 1, 2, 3, 4, and 6 if a purchaser wishes to send media with the greeting card 1.

If the user wishes to send media, the sender fills out the greeting card 1 then loads the media storage devices with desired media data, such as, but not limited to, photos, audio, video, data etc. The manufacturer of greeting card 1 may have a designated web site were the sender or giver may login for a fee or a free download of graphics, art, literature, poetry, video's, etc., or any other content that the manufacturer provides to be downloaded from their website. The sender can then combine and design his/her own literature, photo's, video's etc., with downloads of graphics, art, literature, poetry, videos, etc., from the website to send a customized greeting.

Once the storage devices have been loaded, if the storage compartments are covered with the compartment covers 59, the selected compartment covers 59 can be removed and the appropriate storage devices are then inserted into their designated storage compartments. The storage device supports 49 secure the storage devices in their designated compartments as shown in FIGS. 1 and 4. The compartment covers 59 may be placed over the unused compartments if any, so that it doesn't seem that a storage device is missing.

The receptacle 15 can be closed and secured by tab 55, as shown in FIG. 6.

The insert 23, may be a photo, poetry, etc., and is inserted between the clear laminate 19, and front cover 17 of receptacle 15, as shown in FIG. 5. The greeting card 1, is then formatted or configured to accept the receptacle 15 shown in FIGS. 1, 3, 4 and 6.

The greeting card 1, is opened flat with the face and back of the greeting card 1 facing downward and the inner side of the greeting card 1 is facing upward. A finger can be used to press out the crease 9 to expand the spine 7 to receive spine 25 of the receptacle and to configure the greeting card to operate with both hinges 5.

The receptacle 15 is then attached to the greeting card 1 and fastened by fastening means two-way tape 57 as shown in FIGS. 1, 4 and 6.

Receptacle 15 in a closed state is then laid flat with front cover 17 of receptacle 15 laying face down on the inner side of the front cover 3 of greeting card 1, and the back cover 29 of receptacle 15 facing upward. The spine 25 of receptacle 15 and spine 7 of greeting card 1 are aligned with each other, with the bottom of the receptacle 15 being flush with the bottom of the greeting card 1. This allows the weight of the receptacle 15 to support the greeting card 1 when placed in a standing position as shown in FIGS. 1, 4 and 6.

Once the greeting card 1 and the receptacle 15 are properly positioned (preferably with the spine 25 of the of the receptacle 15 pressed into the spine 7 of greeting card 1, and the bottom edges of the receptacle 15 flush with the bottom edges of the greeting card 1), the non-adhesive strip of the two-way tape 57 is removed and the back cover of greeting card 1 is pressed on to the back cover 29 of receptacle 15, as shown in FIGS. 1, 4 and 6.

The combination of the greeting card 1 and receptacle 15 with loaded media storage devices, is placed into the accordion design envelope 61 as shown in FIG. 8. and can be mailed.

When the recipient opens the greeting card 1, the storage devices can be removed from the receptacle and connected to an appropriate viewing device, the recipient can view the content included by the sender. The literature, art, photos, videos, music etc. can be selectively printed by the receiver. This allows the sender to send a quantity of contents and allows the receiver to print just the desired contents of their choice. The storage devices can then be reinserted into their designated compartments of the receptacle 15 and can be closed and the greeting card 1 placed on a self in a standing position which can be made part of a photo, video, audio, etc., album. A title and date may be written on the spine 7 of greeting card 1 to identify each individual, occasion, card, or album.

While I have shown, and described in considerable detail, what I consider to be the preferred form of my invention, it will be understood by those skilled in the art that various changes may be made in the shape 'and arrangement of the several parts of the device, and that such details are not to limit the scope of my claims.

What I claim as my invention is:

1. An enhanced greeting card configurable to contain media stored on one or more data storage devices, comprising:

a greeting card, the greeting card including:

a front cover having at least one edge;

a back cover having at least one edge; and a greeting card spine formed between the at least one edge of the front cover and the at least one edge of the back cover, the at least one edge of the front cover being hingedly coupled to the greeting card spine along a greeting card first hinge, and the at least one edge of the back cover being hingedly coupled to the spine along a second greeting card hinge; and a receptacle including:

a front receptacle cover having at least one edge;

a back receptacle cover having at least one edge; and a receptacle spine formed between the at least one edge of the front receptacle cover and the at least one edge of the back receptacle cover, the at least one edge of the front receptacle cover being hingedly coupled to the receptacle spine along a first receptacle hinge, and the at least one edge of the back receptacle cover being hingedly coupled to the receptacle spine along a second receptacle hinge, and a receptacle body formed between the front and back receptacle covers by the receptacle spine, the receptacle body including at least one compartment dimensionally configured for receiving and holding at least one of the data storage devices, and wherein the spine of the receptacle is cooperatively received by the spine of the greeting card so that the first and second hinges of the greeting card cooperatively align with the first and second hinges of the receptacle respectively, and an outside surface of the back cover of the receptacle is fastened to an inside surface of the back cover of the greeting card so that the second hinge of the greeting card operates coincidentally with the second hinge of the receptacle.

2. The enhanced greeting card of claim 1, wherein the dimensions of the greeting card are larger than the dimensions of the receptacle, so that the receptacle is completely covered by the greeting card.

3. The enhanced greeting card of claim 2, wherein:

the front and back covers of the greeting card and the front and back covers of the receptacle all have a bottom edge, and the bottom edges of the front covers and the bottom edges of the back covers are aligned so that the receptacle provides support necessary to maintain the enhanced greeting card in an upright standing position.

4. The enhanced greeting card of claim 1, wherein the at least one compartment is dimensionally configured to receive and hold a predetermined type of data storage device.

5. The enhanced greeting card of claim 4, wherein the front cover and the back cover of the receptacle include tabs and slots respectively, the tabs and slots being configured to mechanically cooperate to hold the front and back covers of the receptacle in a closed position, thereby retaining the at least one storage device within the at least one compartment.

6. The enhanced greeting card of claim 4, wherein the front cover and the back cover of the receptacle include tabs and slots respectively, the tabs and slots being configured to mechanically cooperate to hold the front and back covers of the receptacle in a closed position, thereby retaining the at least one storage device within the at least one compartment.

* * * * *